US006467131B1

(12) United States Patent
Howie, Jr.

(10) Patent No.: US 6,467,131 B1
(45) Date of Patent: Oct. 22, 2002

(54) FRICTION FIT KNOB WITH ANTI-TORQUE CAPABILITIES

(75) Inventor: Robert K. Howie, Jr., Decatur, IL (US)

(73) Assignee: The Grigoleit Company, Decature, IL (US)

( * ) Notice: Subject to any disclaimer, the term of this patent is extended or adjusted under 35 U.S.C. 154(b) by 0 days.

(21) Appl. No.: 09/865,769

(22) Filed: May 25, 2001

Related U.S. Application Data

(60) Provisional application No. 60/208,201, filed on May 31, 2000.

(51) Int. Cl.[7] ..... G05G 9/47
(52) U.S. Cl. ..... 16/441; 74/10 R; 362/23
(58) Field of Search ..... 16/441; 74/10 R; 362/23

(56) References Cited

U.S. PATENT DOCUMENTS 1,938,556 A * 12/1933 Danielson ..... 403/276
3,679,252 A * 7/1972 Howie, Jr. ..... 292/349
3,880,534 A * 4/1975 Schmidt ..... 16/441
3,965,529 A * 6/1976 Hadzimahalis ..... 16/441
4,179,771 A 12/1979 Rankins et al.
4,295,246 A 10/1981 Howie, Jr.
4,441,230 A 4/1984 Howie, Jr.
4,518,297 A * 5/1985 Kraus ..... 24/16 PB
4,923,325 A 5/1990 Howie, Jr.
5,197,161 A 3/1993 Howie, Jr.
5,450,653 A * 9/1995 Howie, Jr. ..... 116/309
5,509,174 A * 4/1996 Worrell ..... 16/441
5,752,759 A * 5/1998 Pizzo ..... 362/26
5,845,365 A 12/1998 Howie, Jr.
5,857,242 A * 1/1999 Pizzo et al. ..... 16/441
6,003,206 A * 12/1999 Hall et al. ..... 16/433

* cited by examiner

*Primary Examiner*—Thomas B. Will
*Assistant Examiner*—Thomas A. Beach
(74) *Attorney, Agent, or Firm*—Cook, Alex, McFarron, Manzo, Cummings & Mehler, Ltd.

(57) ABSTRACT

A molded knob of the type having a knob with a socket located in the knob which socket slips over the end of an irregularly shaped shaft and has fingers which frictionally engage the outer surface of the shaft. The hub has an inner portion surrounded by and separated from the outer portion by a slot with the shaft gripping fingers formed on the inner portion. Complementary meshing ribs and notches are formed in the peripheral walls of the inner and outer core and these ribs and notches engage each other upon rotation of the inner hub portion relative to the outer hub portion to transfer torque forces therebetween.

3 Claims, 1 Drawing Sheet

FRICTION FIT KNOB WITH ANTI-TORQUE CAPABILITIES

This application claims benefit of U.S. Provisional Application Ser. No. 60/208,201 filed May 31, 2000.

SUMMARY OF THE INVENTION

This invention is concerned with a finger-type gripping knob which fits over a shaft. It is particularly concerned with such a knob that prevents high torque from releasing the grip of the fingers.

An object of this invention is a knob which is held firm to a shaft by tensioned fingers and is constructed so that torque applied to the shaft will not cause the fingers to readily release.

Another object of this invention is a knob in which the shaft socket is located in an inner core which can be twisted slightly relative to the outer core so that torque applied to the inner core will be transferred to the outer core and not to the gripping fingers.

Another object is a knob where the torque applied to the inner core is transferred to the outer core in such manner that the resistant force includes a tension force in a member opposite to and parallel to the flat of the shaft.

Still another object of this invention is a knob having friction fit fingers to hold a shaft in place in the socket of the knob in which the fingers have greater flexibility because they are formed as part of the wall of an inner core of the socket.

Other objects may be found in the following specification and drawings.

DESCRIPTION OF THE PREFERRED EMBODIMENT

Figure 1:
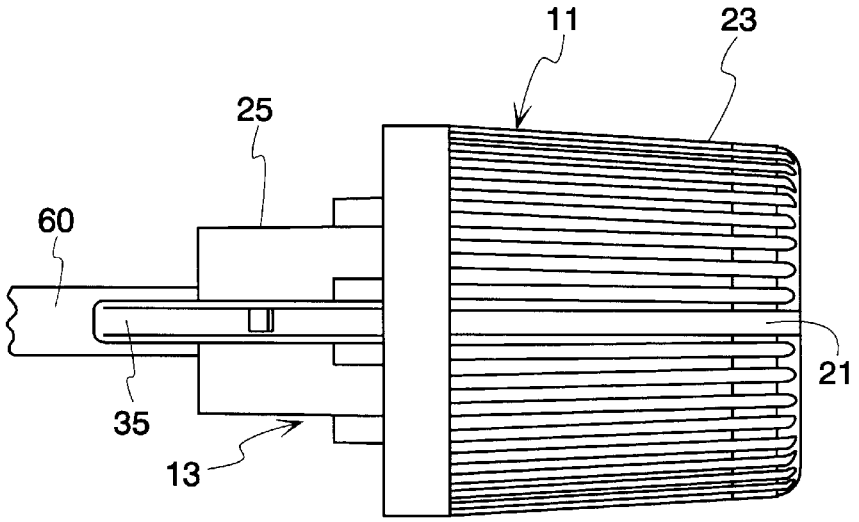
FIG. 1 is an elevational view of a knob incorporating the novel features of this invention.
Figure 3:
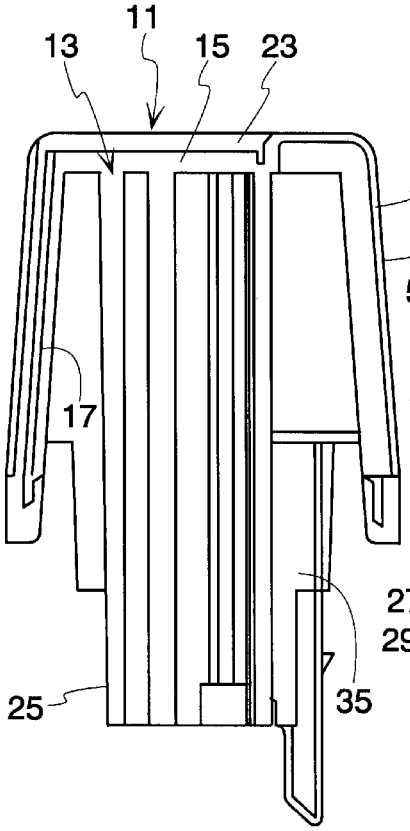
FIG. 3 is a longitudinally extending cross sectional view of the knob of FIG. 1.
Figure 2:
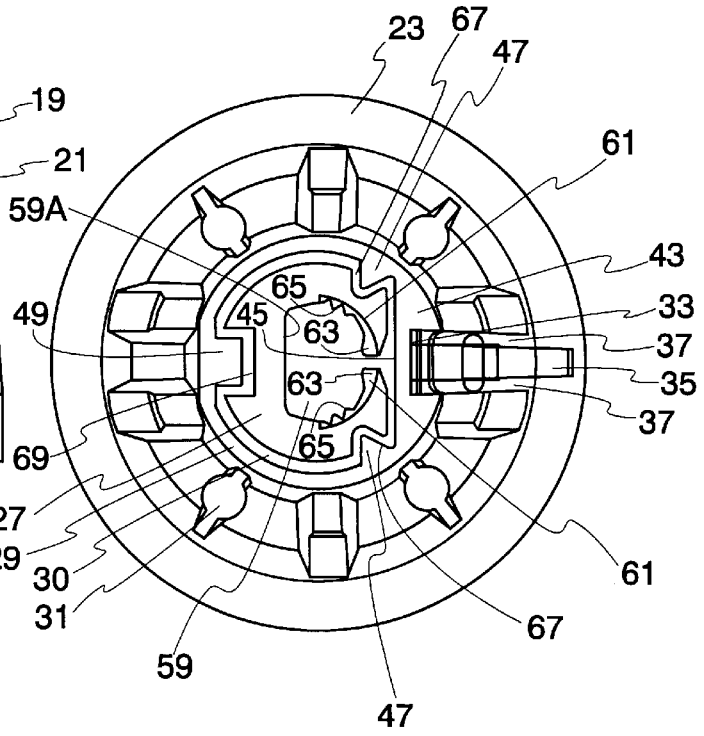
FIG. 2 is an enlarged bottom plan view of the knob of FIG. 1.

FIG. 1 of the drawings shows a composite knob 11 having a core 13 which may be injected molded of a suitable thermoplastic such as a white nylon. The core includes a front wall 15 and an integral side wall 17 in the nature of a skirt extending rearwardly from the front wall. Rearwardly as used herein refers to the direction away from the front wall. A fin 19 is formed in the front and side walls of the core outwardly facing window 21. The window is shown as thinner in cross section than the front and side walls of the core but it should be understood that while this is the preferred embodiment, the window may also have the same thickness as the thickness of the wall or even may be thicker than the front or side walls 15 or 17. An outer covering 23 of a soft plastic is overmolded on the core 13 and encases the core generally except for the window 21 which remains visible from the exterior of the soft overlay 23 on the knob. A knob of this construction is shown generally in my U.S. Pat. No. 5,845,365 which is incorporated herein by reference.

A hub 25 is formed integrally with the core 13 and it includes an inner hub portion 27 and an outer hub portion 29 which are separate from each other by an irregularly shaped slot 30 throughout their lengths but are each integrally formed with the front wall 15 of the core. Ribs 31 extend between the outer hub portion 29 and the wall 17 of the core. An elongated slot 33 is formed in the outer hub portion and this slot receives a light pipe 35 formed of a suitable light transmitting polypropylene plastic. Inverted L-shaped walls 37 formed as part of the outer hub portion 29 terminate short of each other to allow the light pipe located in the slot 33 to extend between them and into the fin 19 of the core. The outer hub portion includes a chordal section 43 having a flat chord wall 45 in which the light pipe slot 33 is formed. Inwardly pointed ribs 47 and a rectangular rib 49 are also formed in the inner peripheral wall of the outer hub portion 29.

An irregularly shaped socket 59 to receive a similarly shaped shaft 60 is formed in the inner hub portion 27. The socket has a flat 59A and the shaft 60 has a corresponding flat. The inner hub portion 27 is U-shape in transverse cross section with an interruption provided between elongated fingers 61 formed as part of the wall defining the inner hub portion 27. These fingers terminate in tips 63. Inwardly of the tips on the inside wall of the inner hub portion 27 are ribs 65 formed near the base of the fingers with both the tips and the ribs positioned to engage a shaft which can be inserted in the socket 59. The fingers 61 may be formed in accordance with the teachings of my U.S. Pat. No. 4,923,325 which is incorporated herein by reference.

Notches 67 are formed in the outer walls of the inner hub portion to receive the pointed ribs 47 of the outer hub portion 29. A rectangular groove 69 is formed in the outer wall of the inner hub portion 27 to receive the rectangular rib 49 of the outer hub portion 29. These ribs and notches engage one another to limit rotation of the inner hub portion 27 relative to the outer hub portion 29 and thus absorb any torque applied to the core 13 by rotation of a shaft located in the socket 59. Thus, the thrust exerted by the turning of the shaft will be applied to the outer hub portion 29 and will not tend to release the fingers 61 which are holding the shaft in the socket 59. Because the chord wall 45 is flat and the base of the chordal section 43 is relatively thick, engagement of a pointed rib 47 of the outer hub portion 29 with a notch 67 of the inner hub portion 27 during rotation of the knob 11, will not bend or distort the chordal section 43 but instead will apply a tension force to chordal section 43 along the flat wall 45 which is opposite and parallel to the flat of the shaft 60 seated in the socket 59. The chordal section 43 functions like a truss of a bridge connecting the pointed ribs 47 of the outer hub portion 29 and will not twist or stretch when torque is applied to the ribs by the sockets 67 of the inner core member 27.

What is claimed is:

1. A molded knob of the type which frictionally engages and slips over the end of a shaft having an outer surface at least a portion of which outer surface is curved and another portion is flat, said knob having a core, said core having a front wall, side walls and a hub, said hub having an inner hub portion and an outer hub portion, said inner hub portion and said outer hub portion formed integrally with said front wall of said knob and extending axially therefrom with said inner and outer hub portions separated from each other through substantially their entire lengths by a slot, a shaft receiving, axially extending socket formed in said inner hub portion, said socket having a shaft receiving portion with a transverse cross section complementary to the transverse cross section of the shaft and having an entrance at one end of said inner hub portion to received said shaft, a pair elongated fingers formed as part of said inner hub portion and located adjacent each other at a curved portion of said socket, said fingers extending axially into said socket from the entrance thereof and projecting generally radially into said shaft receiving portion of said socket with each finger terminating in a tip close to but out of contact with the tip of the other finger, said inner hub portion having an outer peripheral wall and said outer portion having an inner peripheral wall with said walls facing each other across said slot, complementary ribs and notches formed in said peripheral walls and meshing with one another with said ribs and said notches being engageable with one another upon rotation of said inner hub portion relative to said outer hub portion.

2. The molded knob of claim 1 in which said outer hub portion has a chordal section having a flat wall adjacent said fingers of said inner core portion with said flat wall located parallel to said corresponding flat wall in said socket.

3. The molded knob of claim 2 in which said ribs are formed in said outer hub portion and said chordal section connects said ribs.

* * * * *